US005491380A

United States Patent [19]

Kyushima et al.

[11] Patent Number: 5,491,380

[45] Date of Patent: Feb. 13, 1996

[54] PHOTOMULTIPLIER INCLUDING AN ELECTRON MULTIPLIER FOR CASCADE-MULTIPLYING AN INCIDENT ELECTRON FLOW USING A MULTILAYERED DYNODE

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics, K.K., Hamamatsu, Japan

[21] Appl. No.: 234,152

[22] Filed: Apr. 28, 1994

[30] Foreign Application Priority Data

| | | | |
|---|---|---|---|
| Apr. 28, 1993 | [JP] | Japan | 5-102898 |
| Apr. 28, 1993 | [JP] | Japan | 5-102902 |
| Apr. 28, 1993 | [JP] | Japan | 5-102910 |
| Apr. 30, 1993 | [JP] | Japan | 5-104667 |

[51] Int. Cl.[6] ..... H01J 43/22

[52] U.S. Cl. ..... 313/533; 313/103 R; 313/105 R; 313/103 CM; 313/105 CM; 313/532; 313/535

[58] Field of Search ..... 313/532, 533, 313/534, 535, 536, 537, 540, 541, 542, 544, 103 R, 103 CM, 105 R, 105 CM, 104; 250/214 VT

[56] References Cited

U.S. PATENT DOCUMENTS

| | | | |
|---|---|---|---|
| 4,649,314 | 3/1987 | Eschard . | |
| 4,963,113 | 10/1990 | Muramatsu . | |
| 5,077,504 | 12/1991 | Helvy | 313/532 |
| 5,126,629 | 6/1992 | Chopy . | |

FOREIGN PATENT DOCUMENTS

| | | |
|---|---|---|
| 0078078 | 5/1983 | European Pat. Off. . |
| 3925776 | 3/1990 | Germany . |
| 59-151741 | 8/1984 | Japan . |
| 3147240 | 6/1991 | Japan . |
| 1405256 | 9/1975 | United Kingdom . |

*Primary Examiner*—Donald J. Yusko
*Assistant Examiner*—N. D. Patel
*Attorney, Agent, or Firm*—Cushman Darby & Cushman

[57] ABSTRACT

A photomultiplier which can be easily made compact has a dynode unit having a plurality of dynode plates stacked in an electron incident direction in a vacuum container fabricated by a housing and a base member integrally formed with the housing. Each dynode plate is constituted by welding at least two plates overlapping each other. The welding positions do not overlap each other in the stacking direction of the dynode plates. With this structure, field discharge at the welding portions between the dynode plates can be prevented to reduce noise.

18 Claims, 9 Drawing Sheets

PHOTOMULTIPLIER INCLUDING AN ELECTRON MULTIPLIER FOR CASCADE-MULTIPLYING AN INCIDENT ELECTRON FLOW USING A MULTILAYERED DYNODE

BACKGROUND OF THE INVENTION

1. Field of the Invention

The present invention relates to a photomultiplier and, more particularly, to an electron multiplier for constituting the photomultiplier and cascade-multiplying an incident electron flow or ions by multilayered dynodes.

2. Related Background Art

Conventionally, photomultipliers have been widely used for various measurements in nuclear medicine and high-energy physics as a γ-camera, PET (Positron Emission Tomography), or calorimeter.

A conventional electron multiplier constitutes a photomultiplier having a photocathode. This electron multiplier is constituted by anodes and a dynode unit having a plurality of stages of dynodes stacked in the incident direction of an electron flow in a vacuum container.

SUMMARY OF THE INVENTION

A dynode unit included in a photomultiplier according to the present invention is constituted by a plurality of dynode plates stacked in an incident direction of photoelectrons. Each dynode plate is integrally formed by welding two thin plates 6*a* and 6*b*, as shown in FIG. 1. This is because, according to the current etching technique, when openings serving as dynodes 603 are formed in each dynode plate 6, the minimum value of an interval L between the two openings on the exit side of secondary electrons, which are adjacent to each other on the dynode plate 6, must be determined depending on a thickness T of the dynode plate 6. Therefore, when the dynodes are formed to increase the interval L (a pitch between the dynodes 603 is increased to decrease the opening ratio in the main surface of the plate), the thick dynode plate 6 is directly etched to form desired openings at predetermined positions of the plate. On the other hand, when the dynodes are formed to decrease the interval L (the pitch between the dynodes 603 is decreased to increase the opening ratio in the main surface of the plate), at least two thin films constituting the dynode plate 6 are respectively etched to form the openings serving as the dynodes and then overlapped each other to be integrally formed.

When the dynode plate is to be formed by bonding the thin films 6*a* and 6*b*, the two films are normally welded to be integrally formed. This welding is performed at the same position of the edge of each dynode plate 6 from the viewpoint of manufacturing efficiency. Welding marks W are formed as projections projecting from the corresponding main surfaces of the dynode plates 6 in the stacking direction (FIG. 1). Therefore, the positions of the welding marks W of the adjacent dynode plates 6 are matched with each other with respect to the stacking direction of the dynode plates 6. For this reason, field discharge between the dynode plates 6 can occur at these portions to generate noise.

The photomultiplier according to the present invention has a structure capable of sufficiently and practically preventing the above-described problem.

In more detail, when a compact electron multiplier having the dynode plates 6 at an interval of about 0.16 to 0.17 mm is formed, the interval between two adjacent welding portions A is further decreased to more easily cause field discharge. This must be sufficiently taken into consideration when a compact electron multiplier or photomultiplier including this electron multiplier is to be manufactured.

It is one of objects of the present invention to provide a photomultiplier capable of preventing discharge at welding portions between plates to reduce noise even when the photomultiplier is made compact.

A photomultiplier according to the present invention comprises a photocathode and an electron multiplier including an anode and a dynode unit arranged between the anode and the photocathode.

The electron multiplier is mounted on a base member and arranged in a housing formed integrally with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is constituted by stacking a plurality of stages of dynode plates for respectively supporting at least one dynode for receiving and cascade-multiplying photoelectrons emitted from the photocathode in an incidence direction of the photoelectrons.

The housing may have an inner wall thereof with a conductive metal deposited for applying a predetermined voltage to the photocathode and rendered conductive by a predetermined conductive metal to equalize the potentials of the housing and the photocathode.

The photomultiplier according to the present invention has at least one focusing electrode between the dynode unit and the photocathode. The focusing electrode is supported by a focusing electrode plate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

A plurality of anodes may be provided to the anode plate, and electron passage holes through which secondary electrons pass are formed in the anode plate in correspondence with positions where the secondary electrons emitted from the last-stage of the dynode unit reach. Therefore, the photomultiplier has, between the anode plate and the base member, an inverting dynode plate for supporting at least one inverting dynode in parallel to the anode plate. The inverting dynode plate inverts the orbits of the secondary electrons passing through the anode plate toward the anodes. The diameter of the electron incident port (dynode unit side) of the electron passage hole formed in the anode plate is smaller than that of the electron exit port (inverting dynode plate side). The inverting dynode plate has, at positions opposing the anodes, a plurality of through holes for injecting a metal vapor to form at least a secondary electron emitting layer on the surface of each dynode of the dynode unit.

On the other hand, the photomultiplier according to the present invention may have, between the inverting dynode plate and the base member, a shield electrode plate for supporting at least one shield electrode in parallel to the inverting dynode plate. The shield electrode plate inverts the orbits of the secondary electrons passing through the anode plate toward the anodes. The shield electrode plate has a plurality of through holes for injecting a metal vapor to form at least a secondary electron emitting layer on the surface of each dynode of the dynode unit. In place of this shield electrode plate, a surface portion of the base member opposing the anode plate may be used as an electrode and substituted for the shield electrode plate.

In particular, the electron multiplier comprises a dynode unit constituted by stacking a plurality of stages of dynode plates, the dynode plates spaced apart from each other at predetermined intervals through insulating members in an incidence direction of the electron flow, for respectively supporting at least one dynode for cascade-multiplying an incident electron flow, and an anode plate opposing the last-stage dynode plate of the dynode unit through insulating members. Each dynode plate has a first concave portion for arranging a first insulating member which is provided on the first main surface of the dynode plate and partially in contact with the first concave portion and a second concave portion for arranging a second insulating member which is provided on the second main surface of the dynode plate and partially in contact with the second concave portion (the second concave portion communicates with the first concave portion through a through hole). The first insulating member arranged on the first concave portion and the second insulating member arranged on the second concave portion are in contact with each other in the through hole. An interval between the contact portion between the first concave portion and the first insulating member and the contact portion between the second concave portion and the second insulating member is smaller than that between the first and second main surfaces of the dynode plate. The above concave portion can be provided in the anode plate, the focusing plate, inverting dynode plate and the shield electrode plate.

Important points to be noted in the above structure will be listed below. The first point is that gaps are formed between the surface of the first insulating member and the main surface of the first concave portion and between the second insulating member and the main surface of the second concave portion, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be maintained.

Using spherical or circularly cylindrical bodies as the first and second insulating members, the photomultiplier can be easily manufactured. When circularly cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each dynode plate has an engaging member at a predetermined position of a side surface of the plate to engage with a corresponding connecting pin for applying a predetermined voltage. Therefore, the engaging member is projecting in a vertical direction to the incident direction of the photoelectrons. The engaging member is constituted by a pair of guide pieces for guiding the connecting pin. On the other hand, a portion near the end portion of the connecting pin, which is brought into contact with the engaging member, may be formed of a metal material having a rigidity lower than that of the remaining portion. In the specification the side surface means a surface in parallel to the incident direction of the photoelectrons.

Each dynode plate is constituted by at least two plates, each having at least one opening for forming as the dynode and integrally formed by welding such that the openings are matched with each other to function as the dynode when the two plates are overlapped. To integrally form these two plates by welding, each of the plates has at least one projecting piece for welding the corresponding two plates. The side surface of the plate is located in parallel with respect to the incident direction of the photoelectrons.

The photomultiplier has a structure in which the welding portions of each dynode plate are shifted from each other and changed with respect to the stacking direction to prevent the welding portions between the adjacent dynode plates from being arranged close to each other.

In addition, when projecting pieces projecting from the side surfaces of the dynode plates are welded, projecting welding marks are formed on these projecting pieces. However, in this photomultiplier, the projecting pieces of the adjacent dynode plates are not positioned above (photocathode side) and under (anode plate side) the projecting pieces. Therefore, the interval between the welding portions of the adjacent dynode plates can be increased.

Further, in the preceding and subsequent dynode plates, portions corresponding to the welding portions of the adjacent dynode plates are removed. Therefore, sufficient gaps are formed above (photocathode side) and under (anode plate side) the welding portions.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DETAILED DESCRIPTION OF THE PREFERRED EMBODIMENT

An embodiment of the present invention will be described below with reference to FIGS. 2 to 20.

Figure 2:
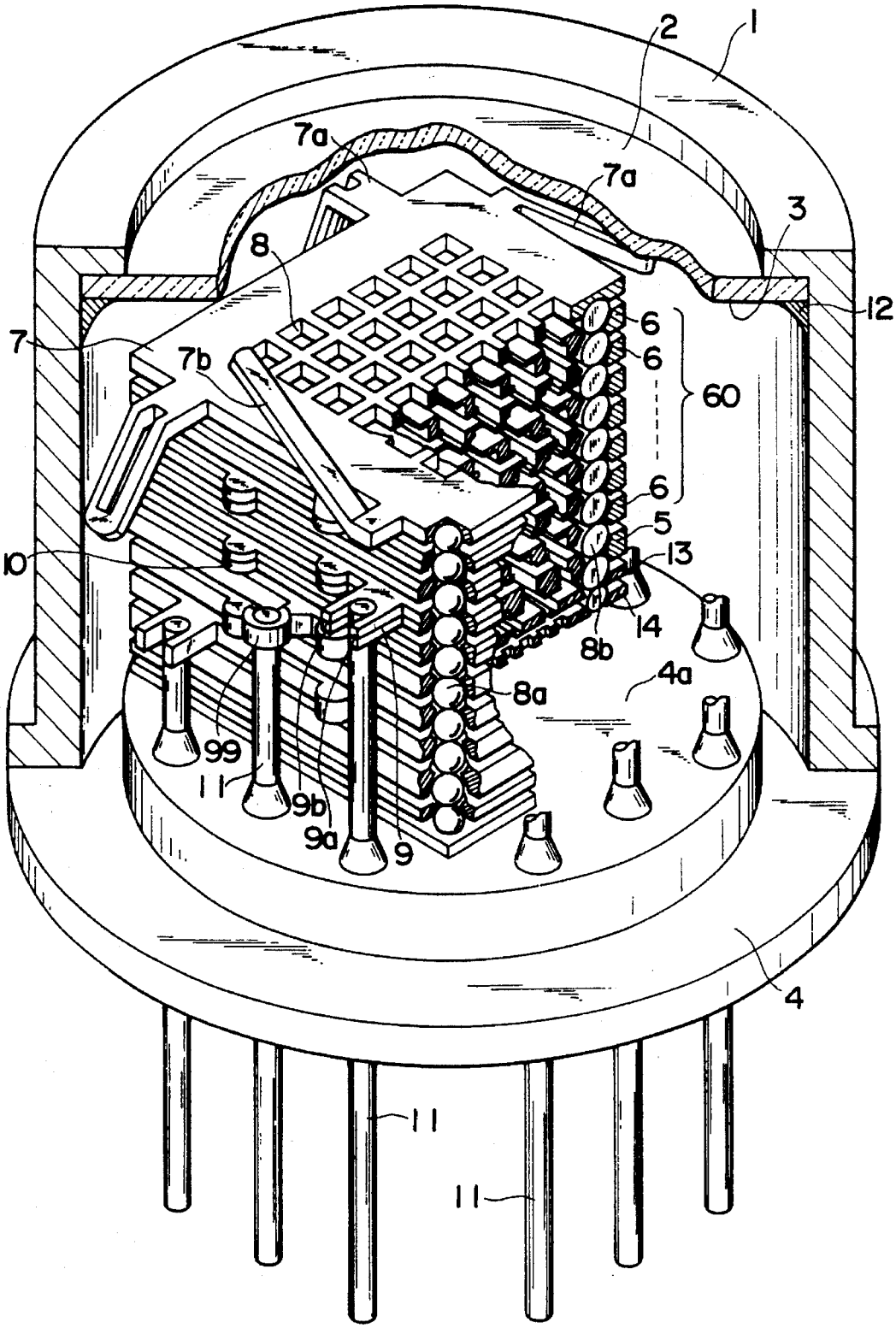
FIG. 2 is a partially cutaway sectional view showing the entire structure of a photomultiplier according to the present invention.

FIG. 2 is a perspective view showing the entire structure of a photomultiplier according to the present invention. Referring to FIG. 2, the photomultiplier is basically constituted by a photocathode 3 and an electron multiplier. The electron multiplier includes anodes (anode plate 5) and a dynode unit 60 arranged between the photocathode 3 and the anodes.

The electron multiplier is mounted on a base member 4 and arranged in a housing 1 which is formed integrally with the base member 4 to fabricate a vacuum container. The photocathode 3 is arranged inside the housing 1 and deposited on the surface of a light receiving plate 2 provided to the housing 1. The anodes are supported by the anode plate 5 and arranged between the dynode unit 60 and the base member 4. The dynode unit 60 is constituted by stacking a plurality of stages of dynode plates 6, for respectively supporting a plurality of dynodes 603 (see FIG. 3) for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members **8*a* and 8*b*. The focusing electrode plate 7 has holding springs 7*a* and contact terminals 7*b*, all of which are integrally formed with this plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3, and the terminals 7*b* function as springs. When the focusing electrode plate 7 has no contact terminal 7*b*, the housing 1 may have, on an inner wall thereof, deposited a conductive metal for applying a predetermined voltage to the photocathode 3, and the contact portion between the housing 1 and the photocathode 3 may be rendered conductive by a predetermined conductive metal 12 to equalize the potentials of the housing 1 and the photocathode 3. Although both the contact terminals 7*b* and the conductive metal 12 are illustrated in FIG. 2**, one structure can be selected and realized in an actual implementation.

Figure 1:
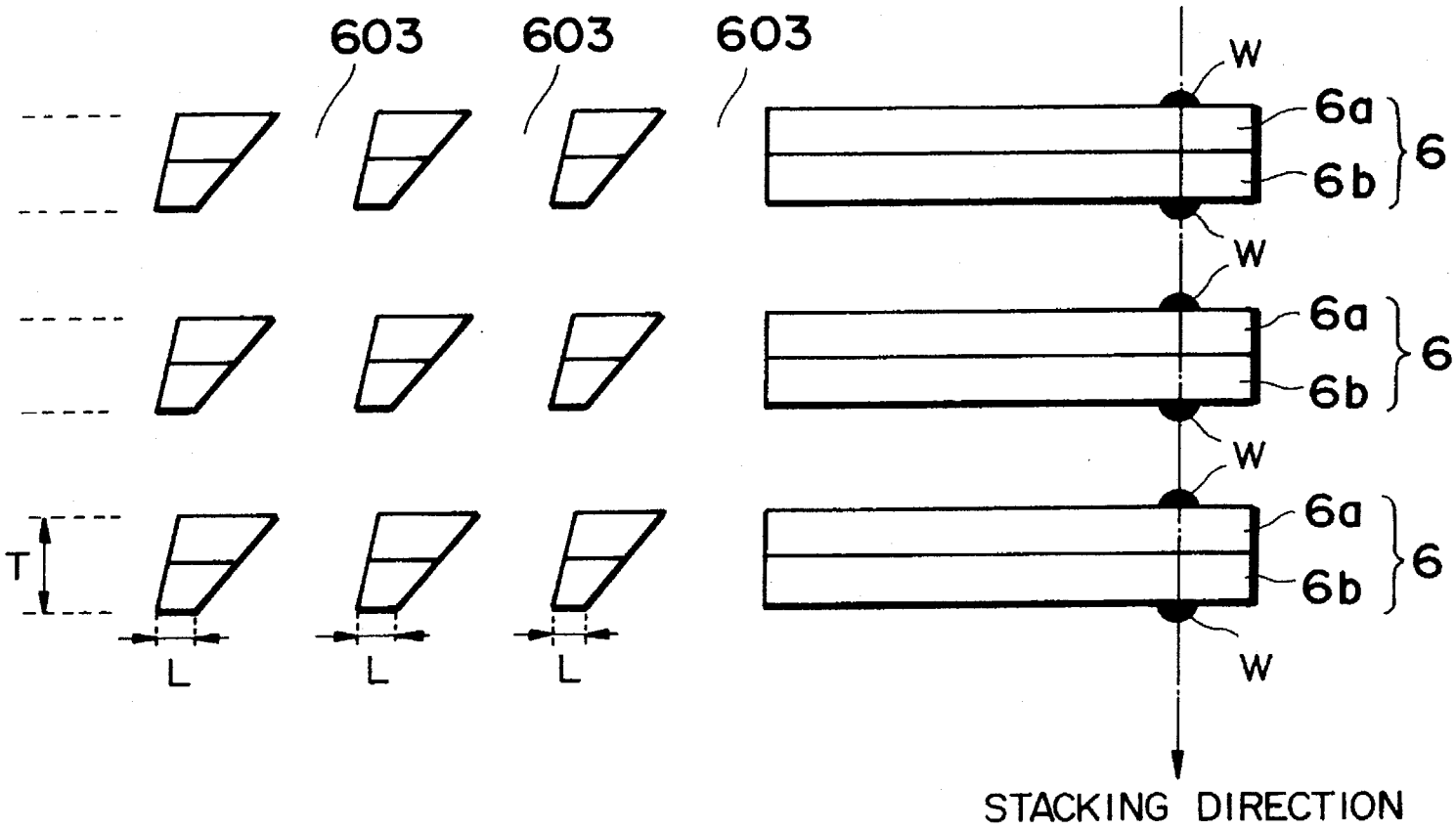
FIG. 1 is a sectional view showing an electron multiplier as a comparative example for explaining the effect of the present invention.

The anode is supported by the anode plate 5. A plurality of anodes may be provided to this anode plate 5, and electron passage holes through which secondary electrons pass are formed in the anode plate 5 in correspondence with positions where the secondary electrons emitted from the last-stage dynode of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 603 (FIG. 1) of the dynode unit 60.

On the other hand, the photomultiplier may have, between the inverting dynode plate 13 and the base member 4, a shield electrode plate 14 for supporting sealed electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form a secondary electron emitting layer on the surface of each dynode 603 of the dynode unit 60. In place of this shield electrode plate 14, a surface portion **4*a* of the base member 4 opposing the anode plate 5 may be used as a sealed electrode and substituted for the shield electrode plate 14**.

In particular, the electron multiplier comprises a dynode unit 60 constituted by stacking a plurality of stages of dynode plates 6, spaced apart from each other at predetermined intervals by the insulating members **8*a* and 8*b* in the incidence direction of the electron flow, and each dynode plate 6 is supporting a plurality of dynodes 603 for cascade-multiplying an incident electron flow, and the anode plate 5 opposing the last-stage dynode plate 6 of the dynode unit 60 through the insulating members 8***a* and 8*b*.

In this electron multiplier, each dynode plate 6 has an engaging member 9 at a predetermined position of a side surface of the plate to engage with a corresponding connecting pin 11 for applying a predetermined voltage. The side surface of the dynode plate 6 is in parallel with respect to the incident direction of the photoelectrons. The engaging member 9 is constituted by a pair of guide pieces 9*a* and 9*b* for guiding the connecting pin 11. The engaging member may have a hook-like structure (engaging member 99 illustrated in FIG. 2). The shape of this engaging member is not particularly limited as long as the connecting pin 11 is received and engaged with the engaging member. On the other hand, a portion near the end portion of the connecting pin 11, which is brought into contact with the engaging member 9, may be formed of a metal material having a rigidity lower than that of the remaining portion.

Each dynode plate 6 used is constituted by two plates 6*a* and 6*b* (FIG. 1) having openings for forming the dynodes and integrally formed by welding such that the openings are matched with each other to function as dynodes when the two plate are overlapped each other. To integrally form the two plates 6*a* and 6*b* by welding, the two plates 6*a* and 6*b* have projecting pieces 10 for welding the corresponding projecting pieces thereof at predetermined positions matching when the two plates 6*a* and 6*b* overlap each other.

Figure 3:
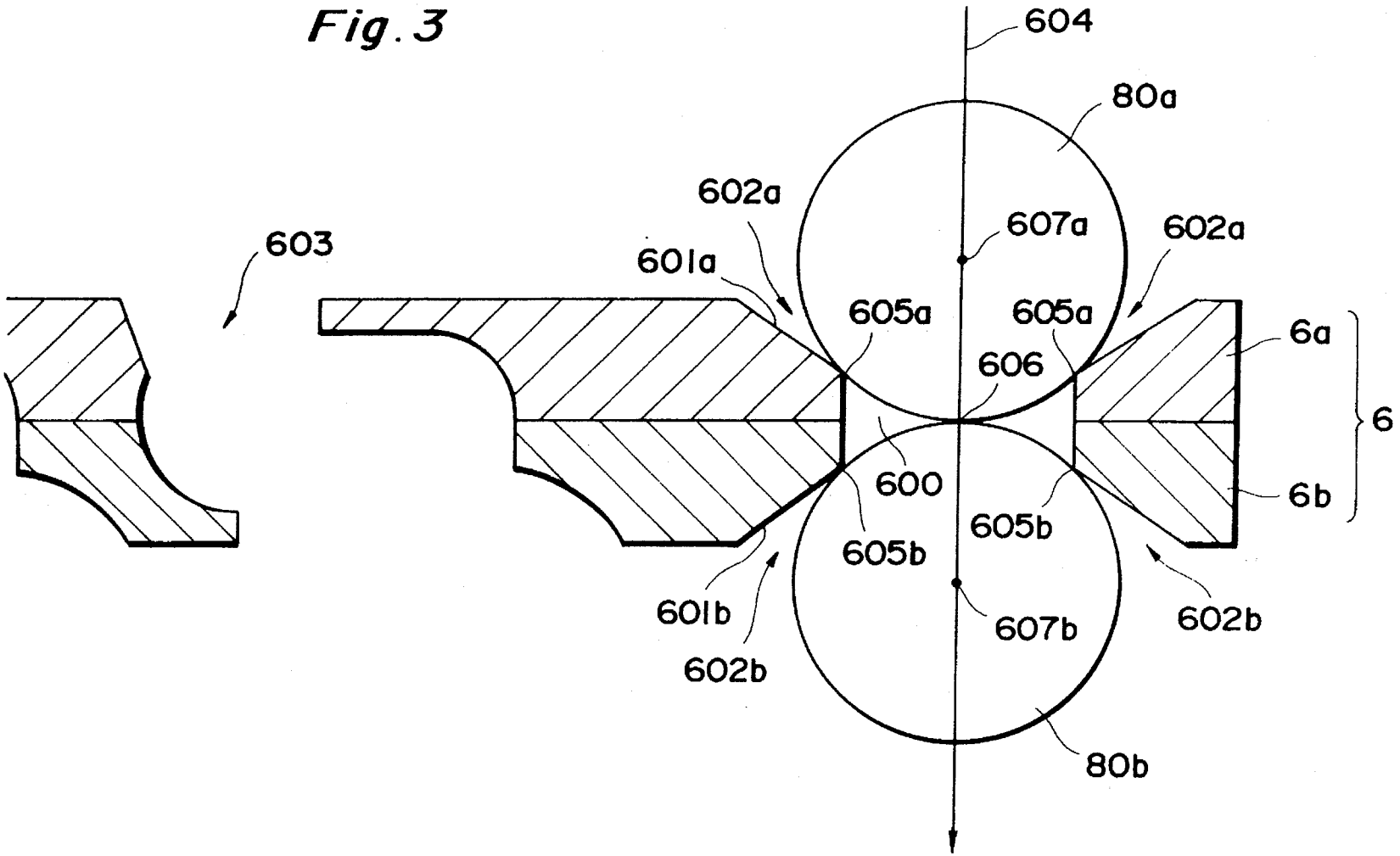
FIG. 3 is a sectional view showing a typical shape of a concave portion formed in a dynode plate in the photomultiplier according to the present invention.

The structure of each dynode plate 6 for constituting the dynode unit 60 will be described below. FIG. 3 is a sectional view showing the shape of the dynode plate 6. Referring to FIG. 3, the dynode plate 6 has a first concave portion 601*a* for arranging a first insulating member 80*a* which is provided on a first main surface of the dynode plate 6 and partially in contact with the first concave portion 601*a* and a second concave portion 601*b* for arranging a second insulating member 80*b* which is provided on a second main surface of the dynode plate 6 and partially in contact with the second concave portion 601*b* (the second concave portion 601*b* communicates with the first concave portion 601*a* through a through hole 600). The first insulating member 80*a* arranged on the first concave portion 601*a* and the second insulating member 80*b* arranged on the second concave portion 601*b* are in contact with each other in the through hole 600. An interval between the contact portion 605*a* between the first concave portion 601*a* and the first insulating member 80*a* and the contact portion 605*b* of the second concave portion 601*b* and the second insulating member 80*b* is smaller than that (thickness of the dynode plate 6) between the first and second main surfaces of the dynode plate 6.

Gaps 602*a* and 602*b* are formed between the surface of the first insulating member 80*a* and the main surface of the first concave portion 601*a* and between the second insulating member 80*b* and the main surface of the second concave portion 601*b*, respectively, to prevent discharge between the dynode plates 6. A central point 607*a* of the first insulating member 80*a*, a central point 607*b* of the second insulating member 80*b*, and a contact point 606 between the first and second insulating members 80*a* and 80*b* are aligned on the same line 604 in the stacking direction of the dynode plates 6 so that the intervals between the dynode plates 6 can be maintained.

The photomultiplier according to the present invention has a structure in which the focusing electrode plate 7, dynode plates 6 for constituting a dynode unit 60, the anode plate 5, the inverting dynode plate 13, and the shield electrode plate 14 are sequentially stacked through insulating members (insulating members 8*a* and 8*b* shown in FIG. 2) in the incident direction of the photoelectrons emitted from the photocathode 3. Therefore, the above-described concave portions can be formed in the main surfaces of the plates 5, 6, 7, 13, and 14 to obtain a high structural strength and prevent discharge between the plates.

Using the spherical bodies 8*a* or circularly cylindrical bodies 8*b* as the first and second insulating members 80*a* and 80*b* (insulating members 8*a* and 8*b* in FIG. 2), the photomultiplier can be easily manufactured. When circularly cylindrical bodies are used, the side surfaces of the circularly cylindrical bodies are brought into contact with each other. The shape of the insulating member is not limited to this. For example, an insulating member having an elliptical or polygonal section can also be used as long as the object of the present invention can be achieved. Referring to FIG. 3, reference numeral 603 denotes a dynode. A secondary electron emitting layer containing an alkali metal is formed on the surface of this dynode.

The shapes of the concave portion formed on the main surface of the plate 5, 6, 7, 13, or 14 will be described below with reference to FIGS. 4 to 7. For the sake of descriptive convenience, only the first main surface of the dynode plate 6 is disclosed in FIGS. 8 to 11. In these plates, the concave portion may be formed only in one main surface if there is no structural necessity.

Figure 4:
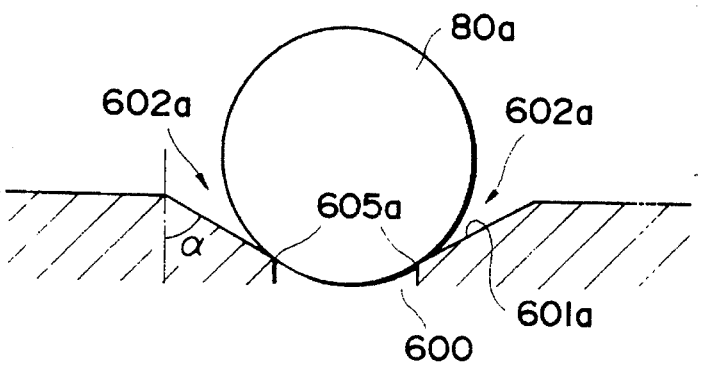
FIG. 4 is a sectional view showing the shape of the concave portion in a first embodiment of the concave portion shown in FIG. 3.

The first concave portion 601*a* is generally constituted by a surface having a predetermined taper angle ($\alpha$) with respect to the direction of thickness of the dynode plate 6, as shown in FIG. 4.

Figure 5:
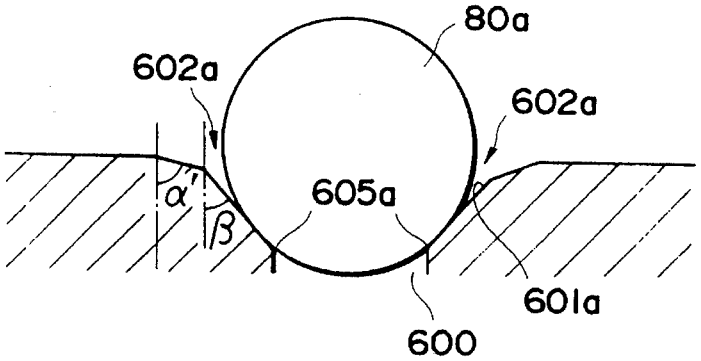
FIG. 5 is a sectional view showing the shape of the concave portion in a second embodiment of the concave portion shown in FIG. 3.

This first concave portion 601*a* may be constituted by a plurality of surfaces having predetermined taper angles ($\alpha$ and $\beta$) with respect to the direction of thickness of the dynode plate 6, as shown in FIG. 5.

Figure 6:
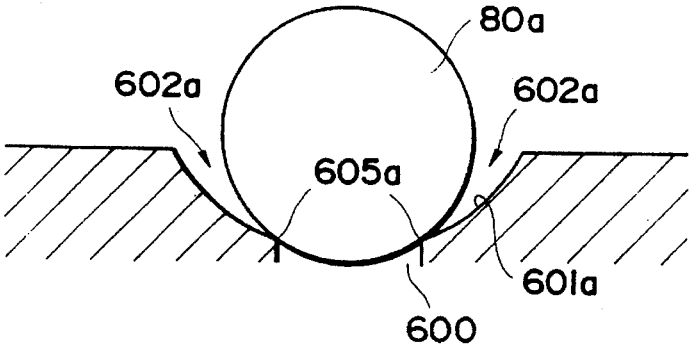
FIG. 6 is a sectional view showing the shape of the concave portion in a third embodiment of the concave portion shown in FIG. 3.

The surface of the first concave portion 601*a* may be a curved surface having a predetermined curvature, as shown in FIG. 6. The curvature of the surface of the first concave portion 601*a* is set smaller than that of the first insulating member 80*a*, thereby forming the gap 602*a* between the surface of the first concave portion 601*a* and the surface of the first insulating member 80*a*.

Figure 7:
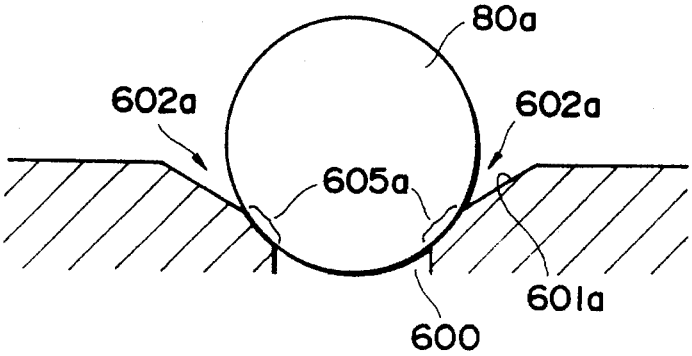
FIG. 7 is a sectional view showing the shape of the concave portion in a fourth embodiment of the concave portion shown in FIG. 3.

To obtain a stable contact state with respect to the first insulating member 80*a*, a surface to be brought into contact with the first insulating member 80*a* may be provided to the first concave portion 601*a*, as shown in FIG. 7. In this embodiment, a structure having a high mechanical strength against pressure in the direction of thickness of the dynode plate 6 even compared to the above-described structures in FIGS. 4 to 6 can be obtained.

Figure 8:
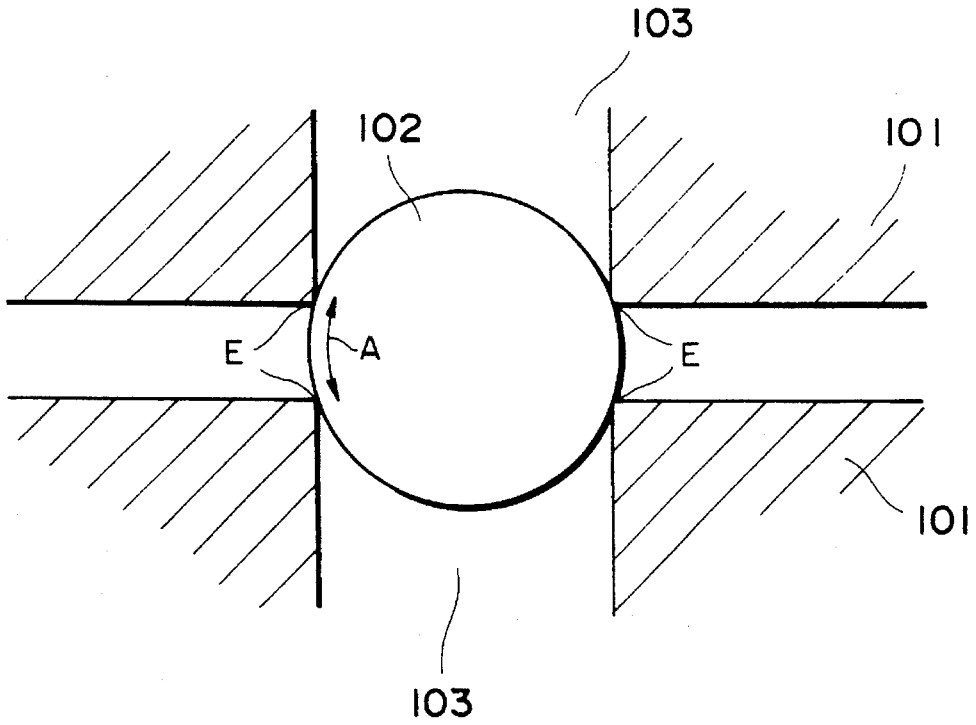
FIG. 8 is a sectional view showing the structure between a dynode and a support member in a conventional photomultiplier as a comparative example for explaining the effect of the present invention.
Figure 9:
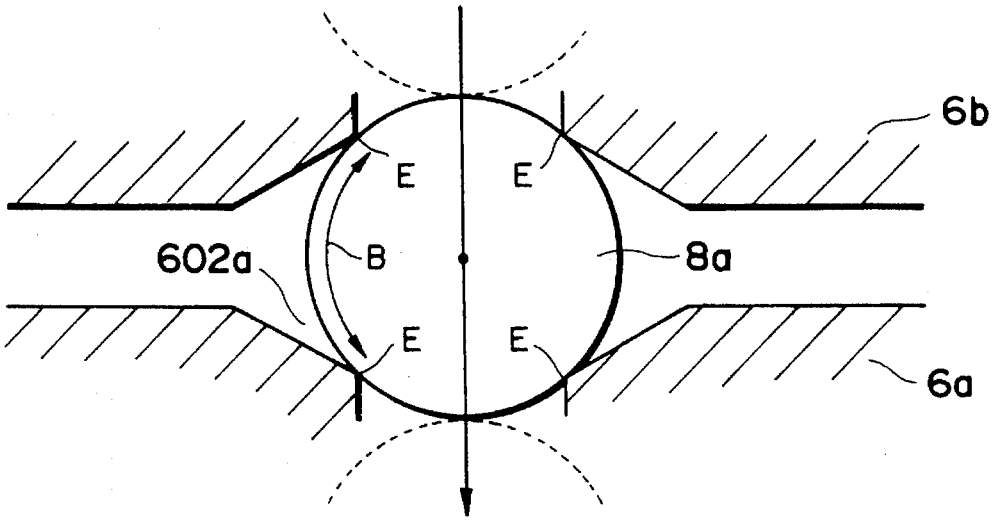
FIG. 9 is a sectional view showing the structure between the dynode plates for explaining the effect of the present invention.

The detailed structure between the dynode plates 6, adjacent to each other, of the dynode unit 60 will be described below with reference to FIGS. 8 and 9. FIG. 8 is a partial sectional view showing the conventional photomultiplier as a comparative example of the present invention. FIG. 9 is a partial sectional view showing the photomultiplier according to an embodiment of the present invention.

In the comparative example shown in FIG. 8, the interval between the support plates 101 having no concave portion is almost the same as a distance A (between contact portions E between the support plates 101 and the insulating member 102) along the surface of the insulating member 102.

On the other hand, in an embodiment of the present invention shown in FIG. 9, since concave portions are formed, a distance B (between the contact portions E between the plates 6*a* and 6*b* and the insulating member 8*a*) along the surface of the insulating member 8*a* is larger than the interval between plates 6*a* and 6*b*. Generally, discharge between the plates 6*a* and 6*b* is assumed to be caused along the surface of the insulating member 8*a* due to dust or the like deposited on the surface of the insulating member 8*a*. Therefore, as shown in this embodiment (FIG. 9), when the concave portions are formed, the distance B along the surface of the insulating member 8*a* substantially increases as compared to the interval between the plates 6*a* and 6*b*, thereby preventing discharge which occurs when the insulating member 8*a* is inserted between the plates 6*a* and 6*b*.

The detailed structure of a photomultiplier according to the present invention will be described below with reference to FIGS. 10 to 20.

Figure 10:
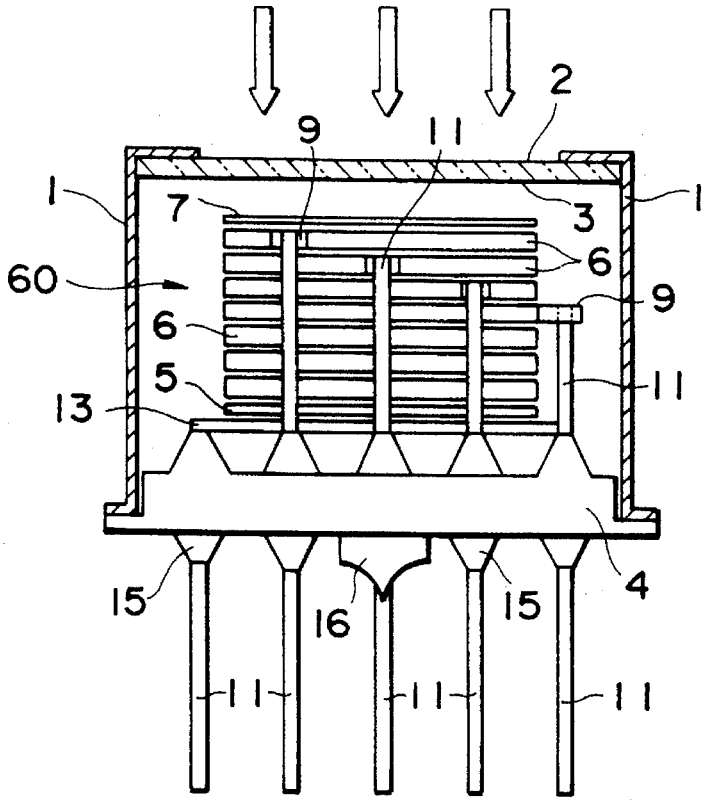
FIG. 10 is a sectional side view showing the internal structure of the photomultiplier according to the present invention.
Figure 11:
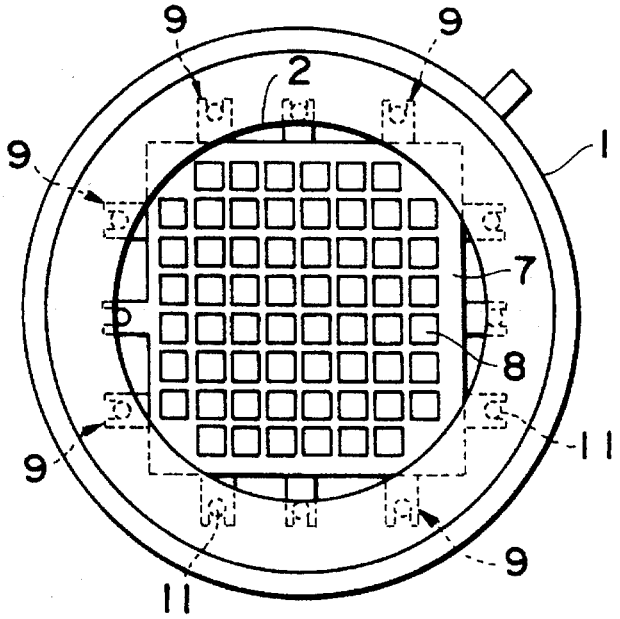
FIG. 11 is a plan view showing the photomultiplier according to the present invention shown in FIGS. 2 and 10.

FIGS. 10 and 11 show a photomultiplier according to this embodiment. In this photomultiplier, a vacuum container is constituted by a circular light receiving plate 2 for receiving incident light, a cylindrical metal side plate (housing 1) disposed along the circumference of the light receiving plate 2, and a circular stem 4 constituting a base member. A dynode unit 60 for cascade-multiplying an incident electron flow is disposed in this vacuum container.

A photocathode 3 is provided on the lower surface of the light receiving plate 2. A focusing electrode plate 7 for supporting focusing electrodes 8 (FIG. 11) is disposed between the photocathode 3 and the dynode unit 60. Therefore, the orbits of the photoelectrons emitted from the photocathode 3 are corrected by the focusing electrodes 8 and the photoelectrons are incident on a predetermined region (first-stage dynode plate 6) of the dynode unit 60.

Twelve connecting pins 11 connected to external voltage terminals to apply a predetermined voltage to the dynode plates 6 or the like extend through the stem 4 serving as a base member. Each connecting pin 11 is fixed to the stem 4 by hermetic glass 15 having a shape tapered from the surface of the stem 4 along the connecting pin 11. Each connecting pin 11 has a predetermined length to reach the corresponding dynode plate 6. The distal end of each connecting pin 11 is resistance-welded to a U-shaped engaging member 9 provided to the corresponding dynode plate 6.

The dynode unit 60 is formed by stacking a plurality of stages of dynode plates 6 each having a plurality of electron multiplication holes (dynodes 603). An anode plate 5 and an inverting dynode plate 13 are sequentially disposed under these multilayered dynode plates 6.

Figure 12:
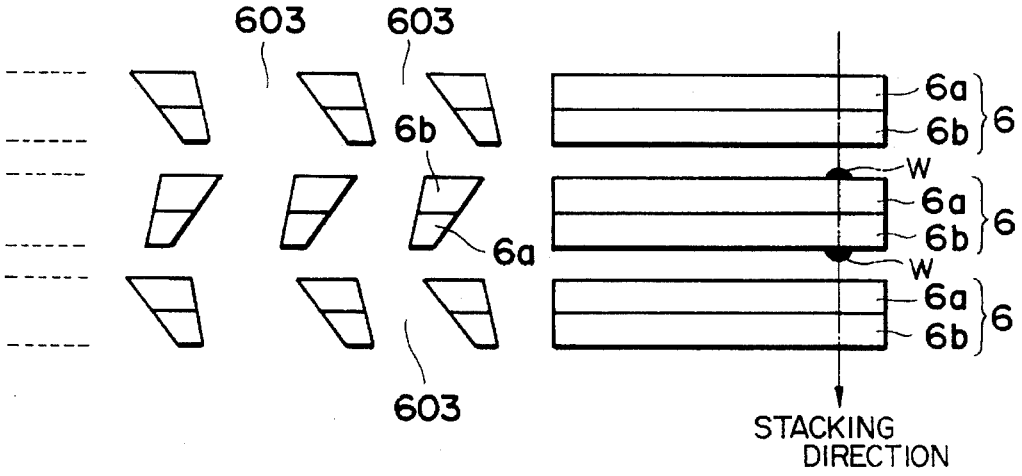
FIG. 12 is a sectional view showing the main part of the first embodiment of a dynode unit constituting a electron multiplier in the photomultiplier according to the present invention.

FIG. 12 is a sectional view showing the first application of the three consecutive dynode plates 6 constituting the dynode unit 60. Each dynode plate 6 is integrally formed by welding a plate 6*a* serving as an upper electrode of the dynode and a plate 6*b* serving as a lower electrode of the dynode. Welding marks W projecting in the stacking direction of the dynode plates 6 are formed on the main surfaces of each dynode plate 6.

Figure 13:
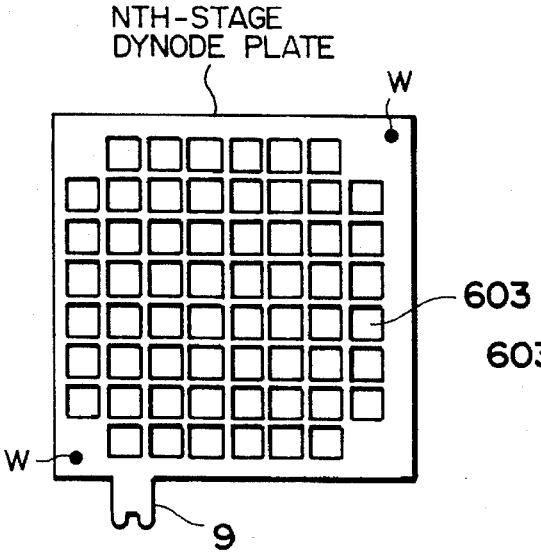
FIG. 13 is a plan view showing the first embodiment of the nth-stage dynode plate constituting the dynode unit shown in FIG. 12.
Figure 14:
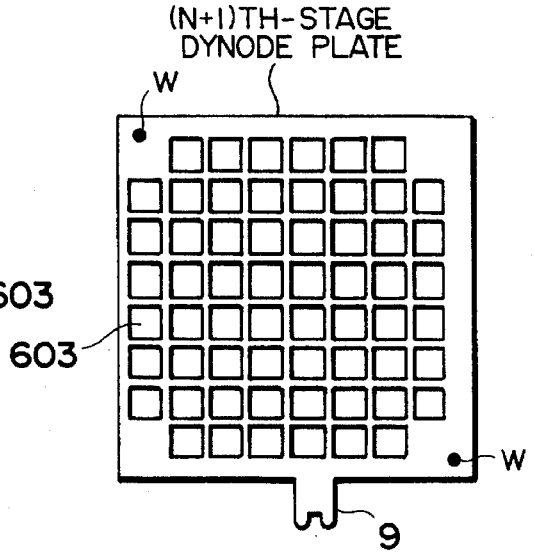
FIG. 14 is a plan view showing the first embodiment of the (n+1)th-stage dynode plate constituting the dynode unit shown in FIG. 12.

FIG. 13 is a plan view showing the nth-stage dynode plate constituting the dynode unit 60. FIG. 14 is a plan view showing the subsequent (n+1)th-stage dynode plate. Each dynode plate is substantially square. Welding is performed at two corner portions opposing each other in one diagonal direction to integrally form each dynode plate. The nth-stage dynode plate has thus the projecting welding marks W formed at the corner portions opposing each other. In the (n+1)th-stage dynode plate, welding is performed at two corner portions opposing each other in the other diagonal direction. The projecting welding marks W are formed also at these positions. The dynode plates 6 constituting the dynode unit 60 are sequentially stacked while alternately changing the positions of the welding marks W, as described above. Therefore, as shown in FIG. 12, the welding marks W formed on the middle dynode plate 6 are not matched with the welding marks W formed on the preceding and subsequent dynode plates 6 in the stacking direction.

Figure 15:
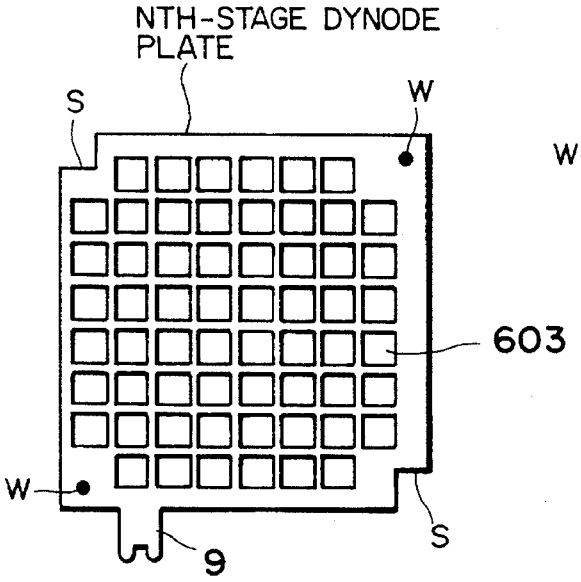
FIG. 15 is a plan view showing a second embodiment of the nth-stage dynode plate constituting the dynode unit.
Figure 16:
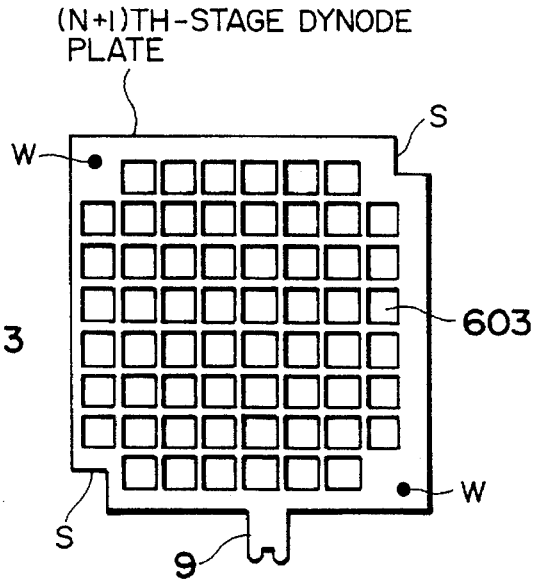
FIG. 16 is a plan view showing the second embodiment of the (n+1)th-stage dynode plate constituting the dynode unit.
Figure 17:
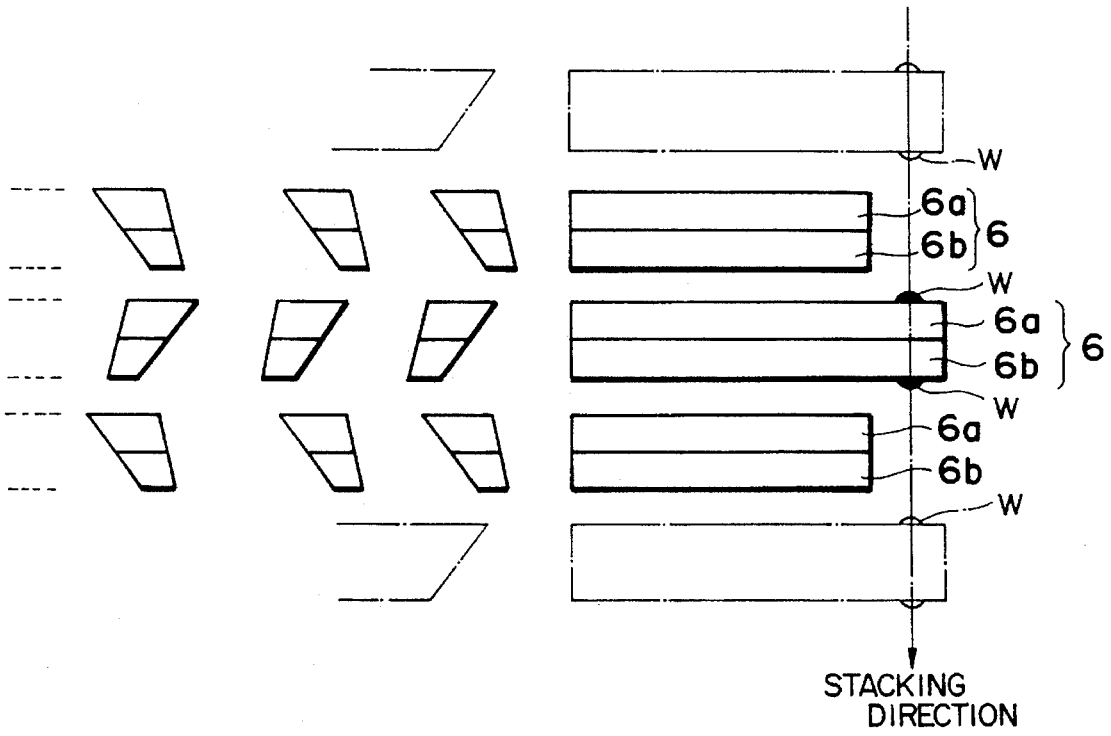
FIG. 17 is a sectional view showing the main part of the second embodiment of the dynode plates including the dynode plates shown in FIGS. 15 and 16.

FIGS. 15 and 16 show the second embodiment of the dynode plates 6. The dynode plates 6 are stacked while alternately changing the welding portions along the diagonal directions, as in the first application. In this case, predetermined portions of the (n+1)th-stage dynode plate (FIG. 16), which oppose the welding marks W of the nth-stage dynode plate (FIG. 15), are removed. In each dynode plate 6, therefore, welding is not performed at these removed portions, and gaps S are formed at the corner portions opposing each other in the other diagonal direction. When the dynode plates 6 formed as described above are sequentially stacked, the preceding and subsequent dynode plates are not positioned above and under the welding marks W formed on each dynode plate in the stacking direction of the dynode plates 6. Therefore, a large gap is formed between the preceding and subsequent dynode plates 6 (FIG. 17).

Figure 18:
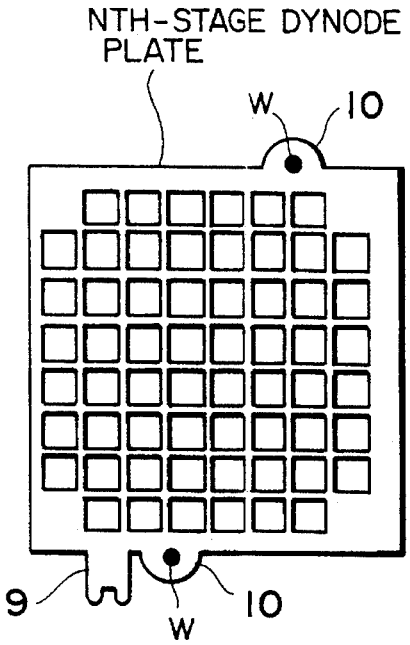
FIG. 18 is a plan view showing the third embodiment of the nth-stage dynode plate constituting the dynode unit.
Figure 19:
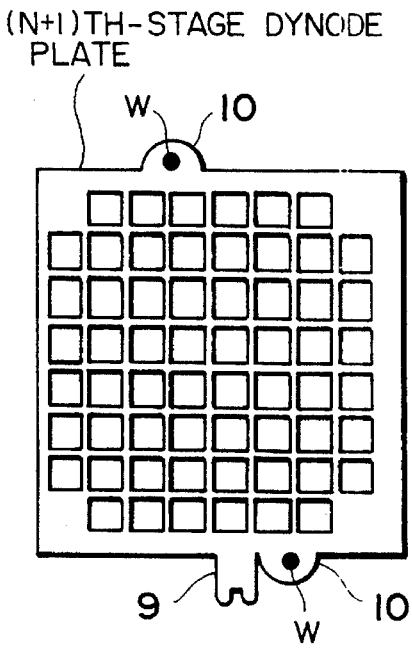
FIG. 19 is a plan view showing the third embodiment of the (n+1)th-stage dynode plate constituting the dynode unit.
Figure 20:
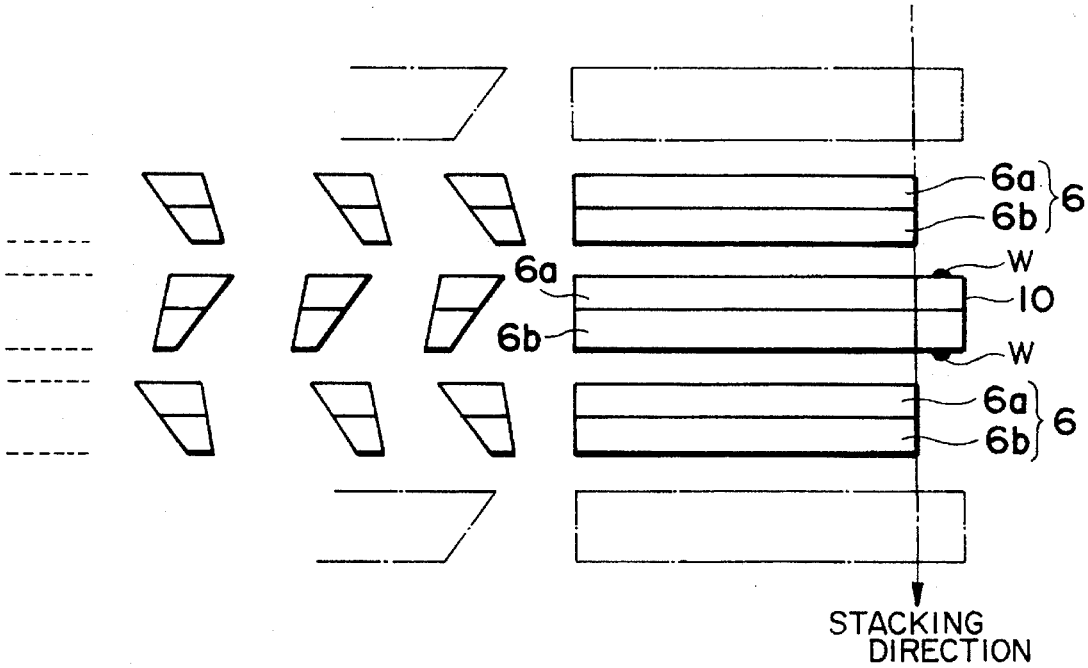
FIG. 20 is a sectional view showing the main part of the third embodiment of the dynode plates including the dynode plates shown in FIGS. 18 and 19.

FIGS. 18 and 19 show the third embodiment of the dynode plates 6. In this case, projecting pieces 10 project from the side surfaces of each dynode plate 6. Each dynode plate 6 is integrally formed by welding the corresponding projecting pieces 10 of the upper and lower plates 6*a* and 6*b*. The positions of the projecting pieces 10 are changed for each dynode plate 6 so that the projecting pieces 10 of the two adjacent dynode plates 6 do not overlap each other. For example, when the projecting pieces 10 are provided at the same positions every other dynode plate, the dynode plates are not positioned above and under the welding marks W (in the stacking direction of the dynode plates). Therefore, a large gap is formed between the preceding and subsequent dynode plates. The projecting pieces 10 can be provided along the side surfaces of the dynode plates while gradually shifting the positions every stage. In this case, the projecting pieces 10 radially project from the side surfaces of the dynode unit 60, like the engaging members 9 shown in FIG. 11.

In the above-described embodiment, each dynode plate 6 is constituted by bonding the upper and lower plates 6*a* and 6*b*. However, the dynode plate 6 can be similarly constituted by three or more plates. Also in this case, the corresponding number of thin plates serving as an upper electrode or the like are welded at the welding portions shown in the above embodiment in the stacking direction of the dynode plates.

In the above embodiment, only a substantially square dynode plate is exemplified. However, the shape is not limited to this, and for example, the dynode plate may have a disk-like shape. In the above embodiment, each dynode plate is constituted by welding the upper and lower plates 6*a* and 6*b* at two portions. However, three or more portions may be welded. In the examples shown in FIGS. 13 to 16, welding is performed at the corners of the dynode plates. However, welding can also be performed along the side surfaces of each dynode plate. In both the cases, it is sufficient to cause the welding portions of the adjacent dynode plates not to overlap each other. In the above embodiment, the dynode plates are disposed in the photomultiplier having the photocathode. However, the dynode plate can also be disposed in the electron multiplier, as a matter of course.

In the photomultiplier according to the present invention, the welding portions of the adjacent dynode plates are changed with respect to the stacking direction of the dynode plates. Therefore, the welding portions of the adjacent dynode plates are prevented from being arranged close to each other. In addition, the welding marks projecting in the stacking direction of the dynode plates are not close to each other. Therefore, field discharge which occurs near these portions can be prevented to reduce the noise caused by this discharge.

Further, this structure is especially effective in a compact electron multiplier or photomultiplier including the electron multiplier. More specifically, in a compact electron multiplier or photomultiplier, the intervals between the dynode plates are further decreased, and the welding marks are thus arranged close to each other to easily cause field discharge. However, with the above structure, the intervals between the welding marks are increased to prevent discharge.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

an anode plate for supporting at least one anode; and a dynode unit having a plurality of stages including a plurality of dynode plates stacked in an incident direction of electrons, said dynode plates spaced apart from each other by insulating members at predetermined intervals such that a last-stage dynode plate of said dynode unit opposes in parallel to a front surface of said anode plate, each said dynode plate supporting at least one dynode for cascade-multiplying the incident electrons and being integrally formed by welding at least two plates overlapping each other in a stacking direction of said dynode plates, wherein a welding position of said at least two plates that overlap each other to form one of said dynode plates of said dynode unit does not overlap in the stacking direction of said dynode plates a welding position of an adjacent dynode plate formed from another of said at least two plates.

2. A multiplier according to claim 1, wherein each of said dynode plates has at least one projecting piece projecting in a direction perpendicular to the stacking direction of said dynode plates adapted for use as a welding portion between said at least two plates constituting said dynode plate.

3. A multiplier according to claim 1, wherein, of said dynode plates of said dynode unit, one of two dynode plates adjacent in the stacking direction of said dynode plates has a shape such that a region opposing a predetermined region including a welding position of the other dynode plate is removed, and said other dynode plate has a shape such that a region opposing a predetermined region including a welding position of said one dynode plate is removed.

4. A multiplier according to claim 1, wherein said anode plate has at least one electron through hole at a position where secondary electrons emitted from said last-stage dynode plate of said dynode unit reach, and further comprising an inverting dynode plate, arranged in parallel to said anode plate such that said anode plate is sandwiched between said last-stage dynode plate of said dynode unit and said inverting dynode plate, for supporting at least one inverting dynode for inverting orbits of the secondary electrons passing through said electron through hole of said anode plate toward said anode.

5. A multiplier according to claim 4, further comprising a shield electrode plate, arranged in parallel to said anode plate such that said inverting dynode plate is sandwiched between said anode plate and said shield electrode plate, for supporting at least one shield electrode for inverting the orbits of the secondary electrons passing through said electron through hole of said anode plate toward said anode.

6. A photomultiplier comprising:

a photocathode;

an anode plate for supporting at least one anode; and a dynode unit provided between said photocathode and said anode plate and having a plurality of stages including a plurality of dynode plates stacked in an incident direction of electrons, said dynode plates spaced apart from each other by insulating members at predetermined intervals such that a last-stage dynode plate of said dynode unit opposes in parallel to a front surface of said anode plate, each said dynode plate supporting at least one dynode for cascade-multiplying photoelectrons emitted from said photocathode and being integrally formed by welding at least two plates overlapping each other in a stacking direction of said dynode plates, wherein a welding position of said at least two plates that overlap each other to form one of said dynode plates of said dynode unit does not overlap in the stacking direction of said dynode plates a welding position of an adjacent dynode plate formed from another of said at least two plates.

7. A photomultiplier according to claim 6, wherein each of said dynode plates has at least one projecting piece projecting in a direction perpendicular to the stacking direction of said dynode plates adapted for use as a welding portion between said at least two plates constituting said dynode plate.

8. A photomultiplier according to claim 6, wherein, of said dynode plates of said dynode unit, one of two dynode plates adjacent in the stacking direction of said dynode plates has a shape such that a region opposing a predetermined region including a welding position of the other dynode plate is removed, and said other dynode plate has a shape such that a region opposing a predetermined region including a welding position of said one dynode plate is removed.

9. A photomultiplier according to claim 6, further comprising a focusing electrode plate, provided between said photocathode and said dynode unit and fixed to a first-stage dynode plate of said dynode unit through insulating members, for supporting at least one focusing electrode for correcting orbits of the photoelectrons emitted from said photocathode.

10. A photomultiplier according to claim 6, wherein said anode plate has at least one electron through hole at a position where secondary electrons emitted from said last-stage dynode plate of said dynode unit reach, and further comprising an inverting dynode plate, arranged in parallel to said anode plate such that said anode plate is sandwiched between said last-stage dynode plate of said dynode unit and said inverting dynode plate, for supporting at least one inverting dynode for inverting orbits of the secondary electrons passing through said electron through hole of said anode plate toward said anode.

11. A photomultiplier according to claim 10, further comprising a shield electrode plate, arranged in parallel to said anode plate such that said inverting dynode plate is sandwiched between said anode plate and said shield electrode plate, for supporting at least one shield electrode for inverting the orbits of the secondary electrons passing through said electron through hole of said anode plate toward said anode.

12. A photomultiplier comprising:

a housing for fabricating a vacuum container, said housing having a light receiving plate;

a photocathode deposited on a surface of said light receiving plate in said housing;

a dynode unit having a plurality of stages including a plurality of dynode plates stacked in an incident direction of photoelectrons emitted from said photocathode, said dynode plates spaced apart from each other by insulating members at predetermined intervals, each said dynode plate supporting at least one dynode for cascade-multiplying the photoelectrons emitted from said photocathode and being integrally formed by welding at least two plates overlapping each other in a stacking direction of said dynode plates;

a base member having said dynode unit mounted thereon and being integrally formed with said housing to constitute said vacuum container having said dynode unit arranged therein; and an anode plate, provided between said dynode unit and said base member, for supporting at least one anode, said anode plate opposing in parallel to a last-stage dynode plate of said dynode unit through insulating members, wherein a welding position of said at least two plates that overlap each other to form one of said dynode plates of said dynode unit does not overlap in the stacking direction of said dynode plates a welding position of an adjacent dynode plate formed from another of said at least two plates.

13. A photomultiplier according to claim 12, wherein each of said dynode plates has projecting pieces projecting in a direction perpendicular to the stacking direction of said dynode plates adapted for use as a welding portion between said at least two plates constituting said dynode plate.

14. A photomultiplier according to claim 12, wherein, of said dynode plates of said dynode unit, one of two dynode plates adjacent in the stacking direction of said dynode plates has a shape such that a region opposing a predetermined region including a welding position of the other dynode plate is removed, and said other dynode plate has a shape such that a region opposing a predetermined region including a welding position of said one dynode plate is removed.

15. A photomultiplier according to claim 12, further comprising a focusing electrode plate, provided between said photocathode and said dynode unit and fixed to a first-stage dynode plate of said dynode unit through insulating members, for supporting at least one focusing electrode for correcting orbits of the photoelectrons emitted from said photocathode.

16. A photomultiplier according to claim 12, wherein said anode plate has at least one electron through hole at a position where secondary electrons emitted from said last-stage dynode plate of said dynode unit reach, and further comprising an inverting dynode plate, arranged in parallel to said anode plate such that said anode plate is sandwiched between said last-stage dynode plate of said dynode unit and said inverting dynode plate, for supporting at least one inverting dynode for inverting orbits of the secondary electrons passing through said electron through hole of said anode plate toward said anode.

17. A photomultiplier according to claim 12, further comprising a shield electrode plate, arranged in parallel to said anode plate such that said inverting dynode plate is sandwiched between said anode plate and said shield electrode plate, for supporting at least one shield electrode for inverting the orbits of the secondary electrons passing through said electron through hole of said anode plate toward said anode.

18. A photomultiplier according to claim 17, wherein said shield electrode plate is part of said base portion which opposes in parallel to said inverting dynode plate.

* * * * *